US008925652B2

(12) United States Patent
Toscher et al.

(10) Patent No.: US 8,925,652 B2
(45) Date of Patent: Jan. 6, 2015

(54) LATERAL WELL DRILLING APPARATUS AND METHOD

(75) Inventors: Steffen Toscher, Lueneburg (DE); Ingo Roders, Seelze (DE); Harald Grimmer, Niedersachsen (DE); Volker Krueger, Celle (DE)

(73) Assignee: Baker Hughes Incorporated, Houston, TX (US)

( * ) Notice: Subject to any disclaimer, the term of this patent is extended or adjusted under 35 U.S.C. 154(b) by 284 days.

(21) Appl. No.: 13/397,422

(22) Filed: Feb. 15, 2012

(65) Prior Publication Data

US 2012/0217068 A1 Aug. 30, 2012

Related U.S. Application Data

(60) Provisional application No. 61/447,189, filed on Feb. 28, 2011.

(51) Int. Cl.

| | |
|---|---|
| ***E21B 7/08*** | (2006.01) |
| ***E21B 7/06*** | (2006.01) |
| ***E21B 21/00*** | (2006.01) |
| ***E21B 7/04*** | (2006.01) |
| ***E21B 21/06*** | (2006.01) |
| ***E21B 41/00*** | (2006.01) |

(52) U.S. Cl.

CPC . *E21B 7/04* (2013.01); *E21B 7/061* (2013.01); *E21B 21/002* (2013.01); *E21B 21/066* (2013.01); *E21B 41/0035* (2013.01)

USPC ..... 175/61; 175/73

(58) Field of Classification Search

CPC ..... E21B 7/061; E21B 7/064; E21B 7/068

USPC ..... 175/61, 62, 73, 75

See application file for complete search history.

(56) References Cited

U.S. PATENT DOCUMENTS

| | | | | |
|---|---|---|---|---|
| 7,013,997 | B2 * | 3/2006 | Vail, III | 175/318 |
| 7,225,887 | B2 | 6/2007 | Kriesels | |
| 7,487,846 | B2 | 2/2009 | Head et al. | |
| 7,677,316 | B2 | 3/2010 | Butler et al. | |
| 7,699,107 | B2 | 4/2010 | Butler et al. | |
| 2002/0074120 | A1 | 6/2002 | Scott | |
| 2006/0054354 | A1 * | 3/2006 | Orban | 175/40 |
| 2007/0029112 | A1 | 2/2007 | Li et al. | |

(Continued)

FOREIGN PATENT DOCUMENTS

GB 2428261 A 1/2007

OTHER PUBLICATIONS

International Search Report and Written Opinioin dated Nov. 26, 2012 for International Application No. PCT/US2012/026946.

*Primary Examiner* — William P Neuder

(74) *Attorney, Agent, or Firm* — Cantor Colburn LLP

(57) ABSTRACT

In one aspect, a drilling apparatus is provided, where the drilling apparatus includes a fluid pump disposed in a main wellbore, a lateral well in fluid communication with the fluid pump and a drilling assembly disposed in the lateral well, wherein the drilling assembly is configured to receive a fluid from the fluid pump to power the drilling assembly and to transport cuttings from the drilling assembly to the main wellbore. The drilling apparatus further includes a sealing mechanism disposed in the main wellbore, the sealing mechanism being configured to direct the cuttings in the fluid downhole of the sealing mechanism.

24 Claims, 4 Drawing Sheets

(56) References Cited

U.S. PATENT DOCUMENTS

| | | | | |
|---|---|---|---|---|
| 2008/0149394 | A1 | 6/2008 | Downton | |
| 2008/0271924 | A1 | 11/2008 | Lurie et al. | |
| 2008/0277166 | A1 | 11/2008 | Orban et al. | |
| 2008/0314643 | A1 * | 12/2008 | Lavrut et al. | 175/62 |
| 2009/0038854 | A1 | 2/2009 | Johnson et al. | |
| 2010/0025115 | A1 | 2/2010 | Kotsonis et al. | |
| 2010/0314174 | A1 * | 12/2010 | Denoix et al. | 175/57 |
| 2012/0031677 | A1 * | 2/2012 | Schulte et al. | 175/61 |
| 2012/0067647 | A1 * | 3/2012 | Savage | 175/61 |
| 2012/0222902 | A1 * | 9/2012 | Alsup et al. | 175/61 |

* cited by examiner

LATERAL WELL DRILLING APPARATUS AND METHOD

CROSS-REFERENCE TO RELATED APPLICATIONS

This application takes priority from U.S. Provisional Application Ser. No. 61/447,189, filed on Feb. 28, 2011, which is incorporated herein in its entirety by reference.

BACKGROUND OF THE INVENTION

1. Field of the Invention

This invention relates to forming lateral wells downhole. In particular, this invention relates to using fluid and assemblies downhole to power and control formation of lateral wells.

2. Description of the Related Art

Wellbores for use in subterranean extraction of hydrocarbons generally comprise a main wellbore section running in a substantially vertical direction along its length. Lateral wellbores may be formed from the main wellbore into the subterranean rock formation surrounding the main wellbore. The lateral wellbores are usually formed to enhance the hydrocarbon production of the main wellbore and can be formed after formation of the main wellbore. Alternatively, the lateral wellbores can be made after the main wellbore has been in production for some time. The lateral wellbores may have a smaller diameter than that of the main wellbores and are often formed in a substantially horizontal direction.

Devices used to form lateral wellbores include equipment that is located at the surface to power and control a drilling assembly downhole as it forms the lateral wellbore, to create a circulation to convey rock cuttings, and to separate and process the rock cuttings. The surface equipment is connected to the downhole equipment with power, communication and other lines. The surface equipment may result in a large footprint, infrastructure and transportation efforts at the surface, which is not desirable.

SUMMARY

In one aspect, a drilling apparatus is provided, where the drilling apparatus includes a fluid pump disposed in a main wellbore, a lateral well in fluid communication with the fluid pump and a drilling assembly disposed in the lateral well, wherein the drilling assembly is configured to receive a fluid from the fluid pump to power the drilling assembly and to transport cuttings from the drilling assembly to the main wellbore. The drilling apparatus further includes a sealing mechanism disposed in the main wellbore, the sealing mechanism being configured to direct the cuttings in the fluid downhole of the sealing mechanism.

In another aspect, method for drilling a lateral well is provided, the method including conveying a pump in a main wellbore and pumping a fluid, using the pump, from the main wellbore to a drill string disposed in the lateral well. The method also includes receiving the fluid in the lateral well to power a drilling assembly and to generate a local circulation proximate the drilling assembly in the lateral well, transporting cuttings within the fluid away from the drilling assembly along an annulus of the drill string and receiving the cuttings within the fluid in the main wellbore, wherein the cuttings and fluid are directed downhole of the fluid pump.

The above-discussed and other features and advantages of the present disclosure will be appreciated and understood by those skilled in the art from the following detailed description and drawings.

BRIEF DESCRIPTION OF THE DRAWINGS

The illustrative embodiments and their advantages will be better understood by referring to the following detailed description and the attached drawings, in which.

DETAILED DESCRIPTION

Figure 1:
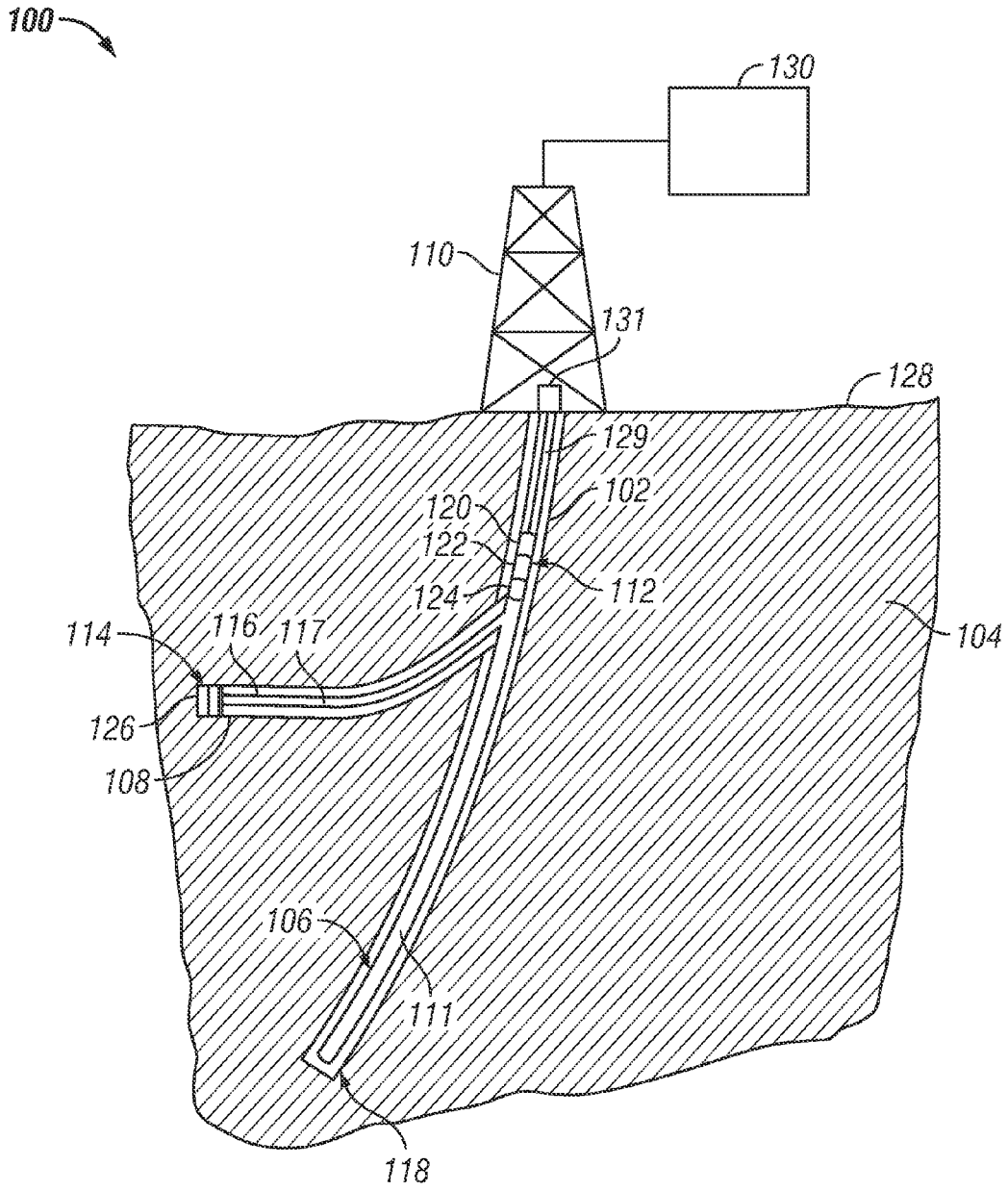
FIG. 1 shows a schematic diagram of a embodiment of a wellbore with an assembly that forms a lateral wellbore.

FIG. 1 is a schematic diagram of an exemplary drilling system 100 (also "drilling apparatus"). The diagram shows a wellbore 102 (also referred to as "main wellbore") formed in formation 104. The drilling system 100 includes a tubular 106 located in wellbore 102, lateral well 108 and drilling rig 110. In an embodiment, the wellbore 102 may be filled with cement. It should be noted that the present drilling system 100 may be used in any suitable land or sea-based application and may include a suitable mast or crane structure. The tubular 106 includes an annulus 111. A main wellbore assembly 112 is located within the inner space of tubular 106 (or "casing"). The main wellbore assembly 112 includes a motor 120, pump 122, and whipstock 124. The motor 120 powers pump 122 to provide a fluid to drilling assembly 114 located at the end of a lateral drill string 116. The lateral drill string 116 (or "drill pipe") includes a tubular member 117, wherein the drilling assembly 114 is coupled to an end of the tubular member 117. The tubular members 106 and 117 may be formed by joining pipe sections or may be composed of a coiled-tubing. A rock destruction device 126 is attached to the bottom end of the drilling assembly 114 (or "lateral drilling assembly") to disintegrate rocks in the formation 104 to form lateral well 108.

The tubular 106 is shown conveyed into the wellbore 102 from the rig 110 at the surface 128. The rig 110 shown is a land rig for ease of explanation. The apparatus and methods disclosed herein may also be utilized when an offshore rig (not shown) is used. As depicted, a wireline 129, conveying line or other suitable conveying device conveys the main wellbore assembly 112 downhole. In an embodiment, the motor 120 is an electric motor configured to power pump 122. As depicted, control unit (or "controller") 130, which is a computer-based unit, is placed at the surface 128 for transmitting data, power and control signals downhole to the main wellbore assembly 112 and drilling assembly 114. Further, the control unit 130 may receive and process data from sensors in the tubular 106 and lateral wellbore 108. The controller 130, in one embodiment, includes a processor, a data storage device (or "computer-readable medium") for storing data and computer programs. The data storage device is any suitable device, including, but not limited to, a read-only memory (ROM), random-access memory (RAM), flash memory, magnetic tape, hard disk and an optical disk. A conveying apparatus 131 is located at the surface 128 to control movement of a conveying line, such as a wireline or the slickline 129. In another embodiment, placement of the drilling assembly 114 does not require use of the tubular 106. If the embodiment does include a cased well, the tubular 106 (i.e. the casing string) is deployed and cemented into the main wellbore 102 before the drilling assembly 114 is deployed.

Still referring to FIG. 1, the main wellbore assembly 112, in one embodiment, is configured to provide fluid, via lateral drill string 116, to drilling assembly 114. The fluid flows along lateral drill string 116 to remove rock cuttings and to power a rock destruction device 126 in drilling assembly 114, as will be discussed in detail with reference to FIGS. 2-4 below. The pump 122 pumps fluid from within the main wellbore 102 along lateral drill string 116, wherein the pumped fluid removes rock cuttings from the lateral well and powers the rock destruction device 126, via a suitable rotational drive mechanism, such as a mud motor. In the depicted embodiment with the wellbore 102 with cemented casing, fluid in the main wellbore 102 is limited to fluid in the inner space 111 of tubular 106. In embodiments, the rock destruction device 126 is powered via a suitable electric motor. The electric motor may be an additional power source (e.g., in addition to the pump 122) or the main power source for the rock destruction device 126. The pump 122, motor 120 and whipstock 124 provide a local or downhole apparatus that implements a local or downhole fluid circulation and powers drilling assembly 114 in the lateral well 108. The whipstock 124 is any suitable deflection device configured to control fluid flow in and through the main wellbore assembly 112. Drilling assembly 114 is powered via fluid pumped from main wellbore assembly 112, which receives cuttings by the fluid carried from the drilling assembly 114. The main wellbore assembly 112 then directs the cuttings and fluid to a downhole location 118. Accordingly, there are no fluid pumps, fluid supplies, cuttings separators or other mechanisms at surface 128 configured to assist in or power the formation of lateral well 108. Thus, the depicted arrangement reduces a footprint at the surface 128, streamlining operation of the drilling system 100 while reducing equipment and cost. In addition, use of wireline 106 allows the main wellbore assembly 112 to be deployed at several depths within a wellbore 102 as well as moved between wellbores with ease, thereby reducing time used to create lateral wells 108.

Figure 2:
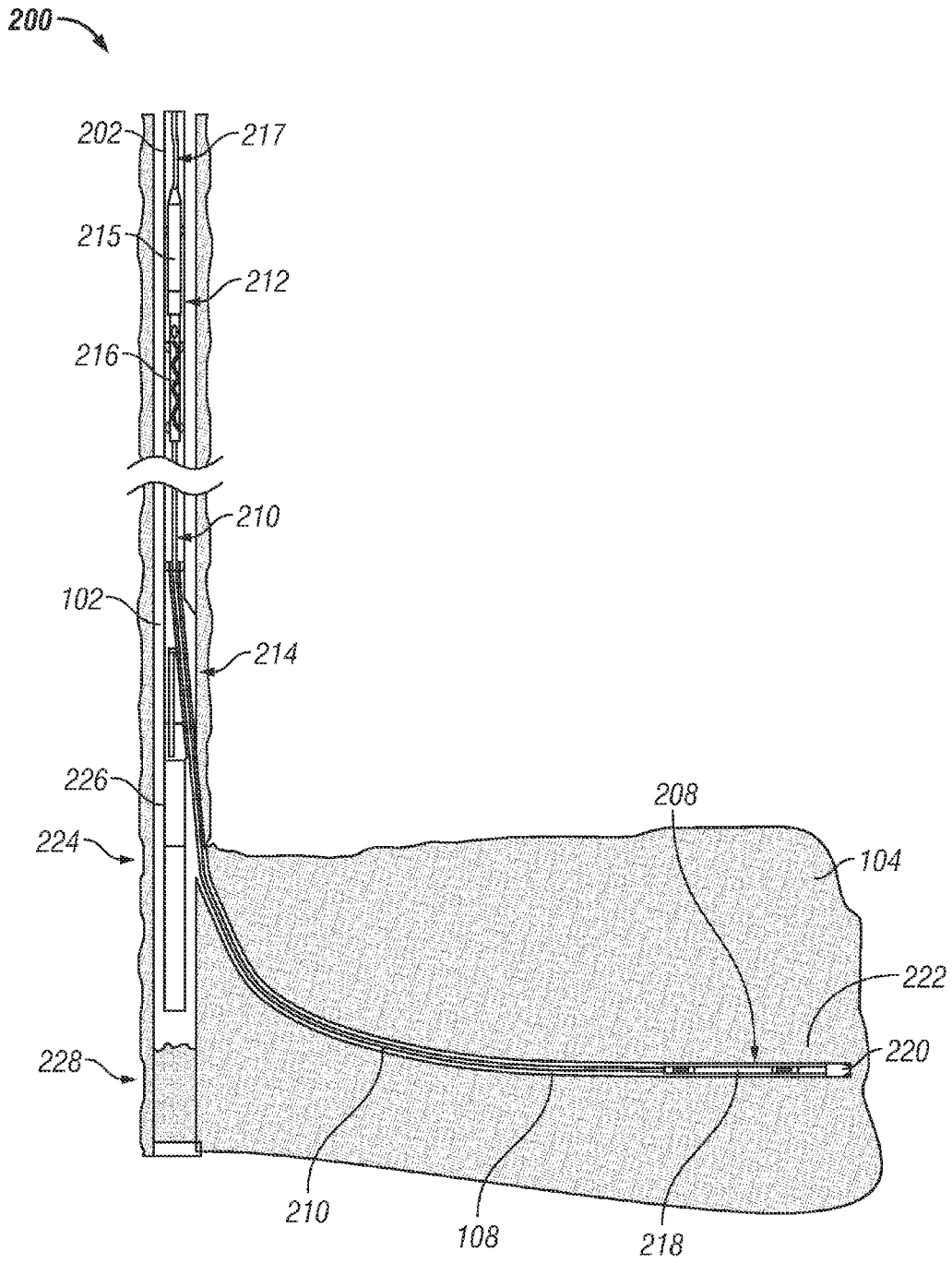
FIG. 2 is a schematic diagram of an embodiment of a drilling apparatus used to form a lateral well.

FIG. 2 is an exemplary schematic illustration of a drilling apparatus 200 used to form lateral well 108 in formation 104. Lateral well 108 extends from main wellbore 102 and is formed by drilling assembly 208 positioned at one end of lateral drill string 210. A main wellbore assembly 212 is positioned at a second end of lateral drill string 210. The main wellbore assembly 212 includes a whipstock 214, motor 215 and pump 216. Control lines 217 lead from the surface 128 (FIG. 1) to the main wellbore assembly 212. In an embodiment, control lines 217 provide power and communication between devices at the surface and downhole. The motor 215 and pump 216 are controlled to provide a local or downhole fluid circulation for cuttings removal from the lateral well 108 and to power to drilling assembly 208 via fluid pumped along lateral drill string 210. The depicted embodiment of drilling assembly 208 includes a mud motor 218 that uses the pumped fluid to actuate a rock destruction device 220, such as a drill bit mechanism. Embodiments may include any suitable rock destruction device 220, such as a drill (e.g., rotary drill bit), hammer mechanism, percussion drilling mechanism, a jet drilling device, a plasma channel, electric pulse, spark drilling device or any combination thereof actuated by suitable mechanism, such as an electric and/or mud motor. The rock destruction device 220 creates cuttings that are carried by the fluid from a distal end 222 of lateral well 108 to a juncture 224 with main wellbore 102. As depicted, fluid and cuttings are routed through whipstock 214 and along casing 226 to a downhole area 228 or suitable receptacle downhole. Accordingly, the cuttings and fluid flowing from the formation of lateral well 108 are directed downhole of the main wellbore assembly 212. Thus, the exemplary main wellbore assembly 212 is a local or downhole circulation source and actuation or power source for drilling assembly 208 when forming lateral well 108, where the main wellbore assembly 212 does not use a surface pump or fluid source to provide pumped fluid to remove cuttings or power the rock destruction device 220, thereby reducing a surface footprint.

Figure 3:
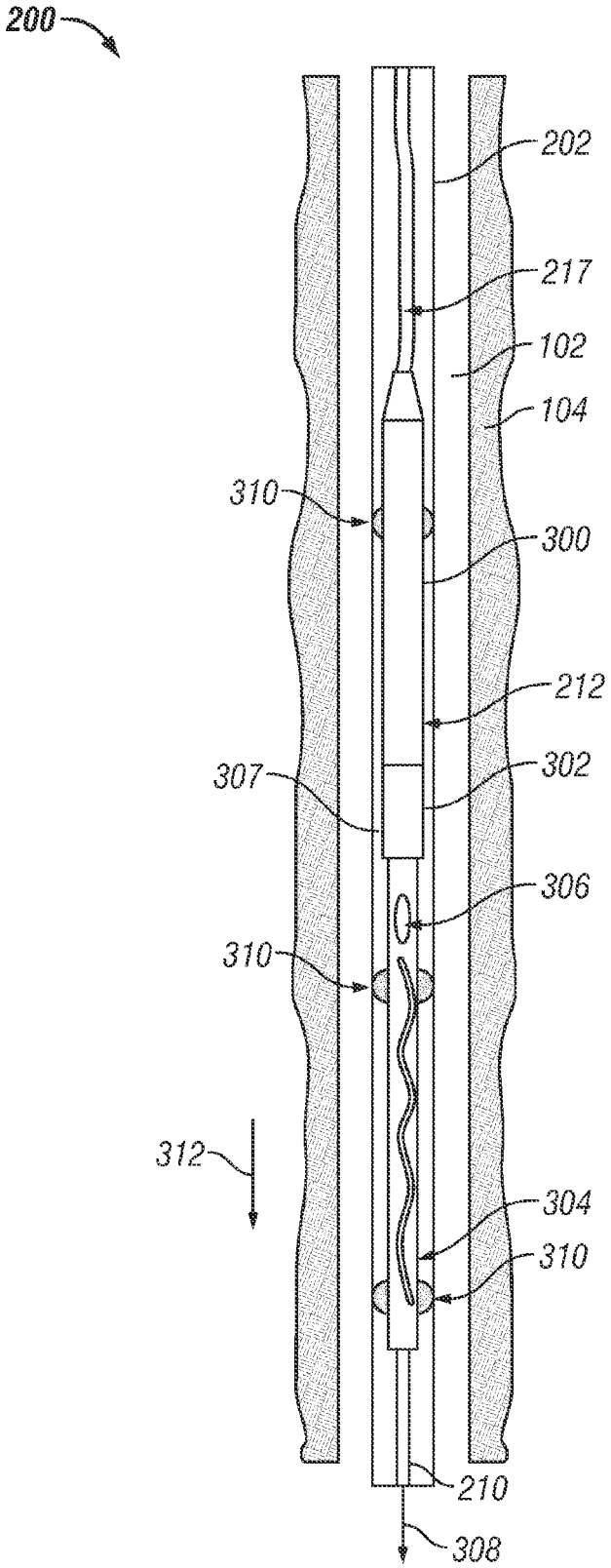
FIG. 3 is a detailed diagram of an embodiment of an assembly to power an assembly in a lateral well.

FIG. 3 is a detailed schematic view of a portion of drilling apparatus 200. The drilling apparatus 200 includes the main wellbore assembly 212 located within a tubular 202 downhole. The main wellbore assembly 212 includes motor 300, gear box 302 and pump 304. In an embodiment, the motor 300 is an electric motor controlled and powered via control lines 216 or by a local power source, such as a battery. The motor 300 is coupled to the pump 304, which is a suitable fluid pump, such as an ESP or progressive cavity pump (also referred to as "reverse mud motor"). The exemplary gear box 302 is optionally included to alter the speed of a rotational output of motor 300 as it is transferred to pump 304. In an alternative embodiment, a variable speed drive control as commonly used in electric drive systems may be used to accomplish altering the rotational output speed of motor 300. The pump 304 receives fluid into port 306 from the annulus 307 to pump into lateral well 108 (FIG. 2). The fluid is pumped through lateral drill string 210 (FIG. 2) into lateral well 108, as shown by arrow 308, to remove cuttings and to power drilling assembly 208 (FIG. 2). An exemplary main wellbore assembly 212 adds a lubricant or other additive to the drilling fluid 308 to improve fluid characteristics and corresponding drilling assembly 208 performance. Guide wheels 310 contact tubular 202 (FIG. 2) to position and to provide a radial contact with the main wellbore assembly 212 in the selected location downhole. In an exemplary embodiment, the guide wheels 310 are powered by control lines 216 and/or motor 300 and provide force to lateral drill string 210, wherein the force provides weight-on-bit to the drilling assembly 208 and rock destruction device 220. The force provided by the guide wheels 310 may also be used to partially offset and control the weight-on-bit provided by gravitational forces of the main well assembly. Further, the main wellbore assembly 212 may be disposed in any suitable vertical well or near vertical well (102), where one or more lateral wellbores 108 are to be formed as a branch from the main well 102. For example, an exemplary near vertical main well 102 at up to about a 45 degree angle may utilize the depicted main wellbore assembly 212 to form lateral wellbore 108.

Figure 4:
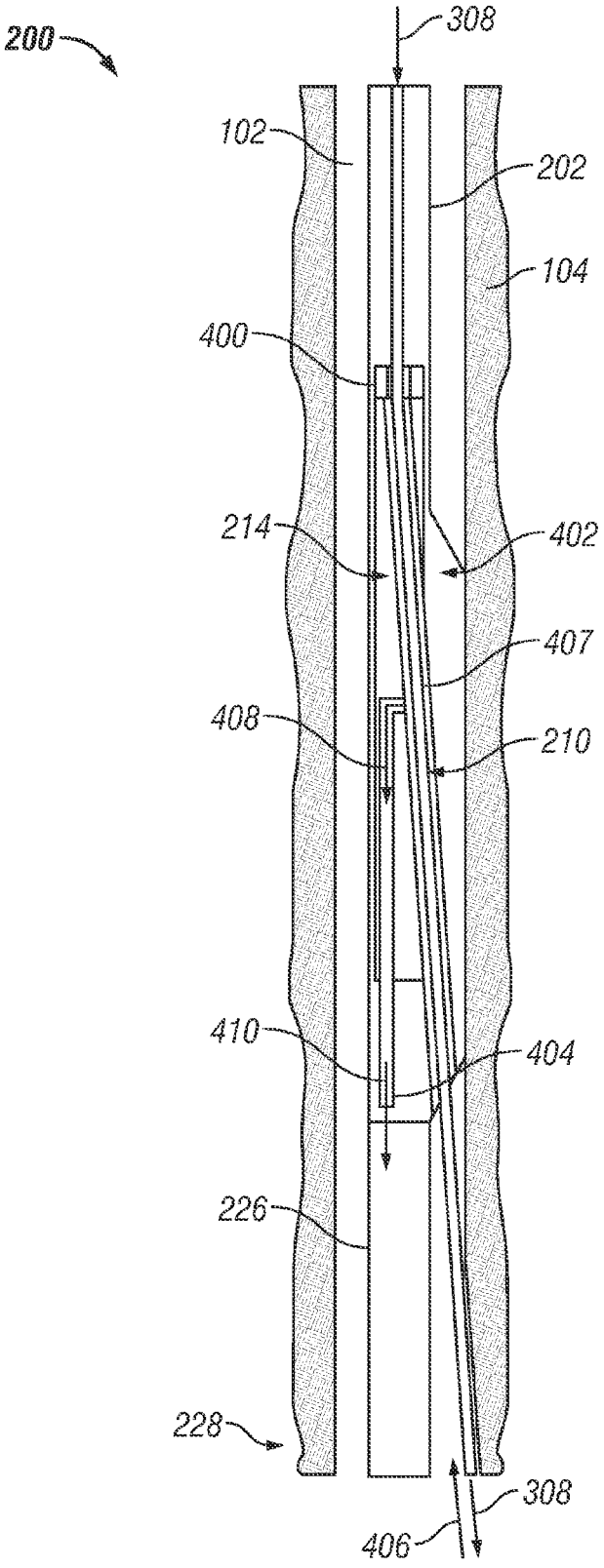
FIG. 4 is a detailed diagram of an embodiment of a portion of an assembly in a main wellbore in fluid communication with a lateral well.

FIG. 4 is a detailed schematic view of another portion of drilling apparatus 200. As depicted, the drilling apparatus 200 includes whipstock 214 (also referred to as "deflection device") disposed about lateral drill string 210. The drilling apparatus 200 also includes a sealing mechanism 400 and cuttings pipe 404. As depicted, the casing sections 202 and 226 and casing window section 402 are located within the main wellbore 102. The fluid 308 is pumped along lateral drill string 210 to provide a local or downhole circulation for cuttings removal and power drilling assembly 208 (FIG. 2). Rock destruction device 220 (FIG. 2) disintegrates portions of formation 104 (FIG. 2) to form lateral well 108 (FIG. 1), thereby creating cuttings that are carried back to the main wellbore 102, as shown by arrow 406. The fluid and cuttings are prevented from flowing uphole along drill string 210 by sealing mechanism 400, which is any suitable mechanism for preventing fluid flow in a selected direction within wellbores or wellbore tubulars. The sealing mechanism 400 is proximate to and/or an integrated part of the whipstock 214. Non-limiting examples of sealing mechanism 400 include packertype devices and O-rings, wherein the sealing mechanism 400 comprises a rubber, elastomer, polymer, metal alloy, stainless steel and/or other suitable materials. By substantially restricting uphole flow, sealing mechanism 400 causes downhole flow in annulus 407, wherein the cuttings and fluid are directed into cuttings pipe 404 as shown by arrow 408. The cuttings and fluid are directed from the cuttings pipe 404 in a downhole direction, as shown by arrow 410. Gravitational force and the weight of the cuttings cause the cuttings to settle downhole, proximate downhole region 228, which is downhole of the main wellbore assembly 212. Portions of the fluid 410 may travel uphole as the cuttings settle in region 228, bypassing the whipstock 214 and seal structure, for example through the annulus between whipstock 214 and casing 202, 226 and/or through openings in the whipstock, where the portion of the fluid 410 is supplied to pump 304. Accordingly, providing fluid communication between the main wellbore above and below the whipstock 214 (through the annulus between whipstock/seal and casing, or main wellbore wall in the embodiment where no casing is present) enables operation of the depicted system. As depicted, casing window section 402 includes a window section in the casing 226 for communication between tubular 202 and lateral well 108 (FIG. 2). In other embodiments, wellbore 102 is not cased, and whipstock 214 provides a coupling between lateral drill string 210 and main wellbore 102.

In an embodiment, the exemplary drilling system 100 is installed as follows. A whipstock 214 is set within wellbore 102, which may include an optional casing 226. In an embodiment, the casing 226 may be a portion of casing 202. In embodiments with casing 226, casing window section 402 is formed downhole or a pre-formed window is conveyed downhole. The motor 215 and pump 216 of main wellbore assembly 112, 212 are then lowered, via wireline or other conveying device, downhole along with lateral drill string 116, 210 and drilling assembly 208. During this step, the components are lowered onto the whipstock 214. The fluid located in wellbore 102 is then pumped into the lateral drill string 116, 210, thus providing a local or downhole fluid circulation for cuttings removal and driving the drilling assembly 208. Further, WOB is applied to the drilling assembly 208 by using wireline control of the weight of the pump 216 to transfer force via lateral drill string 116, 210. As the lateral well 108 is formed by drilling assembly 208, the motor 215 and pump 216 are lowered further into wellbore 102. In embodiments, the main wellbore assembly 112, 212 may be used to form a plurality of lateral wells 108. In one example, after forming a first lateral well 108, the lateral drill string 116 may be retracted into the wellbore 102 and conveyed downhole to form a second lateral well, using the same process used to form first lateral well 108. Accordingly, the exemplary drilling system 100 forms lateral well 108 using local fluid for a local or downhole circulation to remove cuttings from the lateral well and as a power source, reducing a surface equipment footprint, overall time and cost to form lateral well 108.

While preferred embodiments have been shown and described, various modifications and substitutions may be made thereto without departing from the spirit and scope of the invention. Accordingly, it is to be understood that the present invention has been described by way of illustration and not limitation.

What is claimed is:

1. A drilling apparatus comprising:

a fluid pump;

a main wellbore and a lateral well, the lateral well being in fluid communication with the fluid pump;

a drilling assembly disposed in the lateral well, wherein the drilling assembly is configured to receive a fluid from the fluid pump to power the drilling assembly and to transport cuttings from the drilling assembly;

a sealing mechanism disposed in the main wellbore being configured to direct the cuttings in the fluid downhole of the sealing mechanism;

a whipstock providing fluid communication between the main wellbore and the lateral well; and a pipe extending from the whipstock within and separate from a tubular positioned within the main wellbore, the pipe being configured to direct cuttings and fluid downhole therethrough.

2. The drilling apparatus of claim 1, wherein the sealing mechanism is proximate the whipstock.

3. The drilling apparatus of claim 1, comprising a drill string disposed in the lateral well, the drill string providing fluid communication between the fluid pump and the drilling assembly.

4. The drilling apparatus of claim 1, wherein the drilling assembly comprises a rock destruction device.

5. The drilling apparatus of claim 4, wherein the rock destruction device comprises a motor, the motor comprising a mud motor or an electric motor.

6. The drilling apparatus of claim 5, wherein the rock destruction device comprises one of a drill bit, a hammer or a percussion drilling mechanism coupled to the motor.

7. The drilling apparatus of claim 1, wherein the fluid is supplied proximate the main wellbore.

8. The drilling apparatus of claim 1, comprising a surface apparatus including a controller to control the drilling assembly, wherein the surface apparatus does not supply the fluid to the lateral well.

9. The drilling apparatus of claim 1, wherein the fluid with the cuttings is directed downhole of the fluid pump.

10. The drilling apparatus of claim 1, wherein the fluid pump is disposed in the main wellbore by a wireline or coiled tubing.

11. The drilling apparatus of claim 1, wherein the drilling assembly comprises a rock destruction device powered by the fluid received from the fluid pump.

12. The drilling apparatus of claim 11, wherein the drilling assembly comprises a mud motor to power the rock destruction device.

13. The drilling apparatus of claim 1, wherein the fluid pump is disposed in the main wellbore.

14. The drilling apparatus of claim 1, wherein the sealing mechanism is disposed in the main wellbore.

15. A method for drilling a lateral well extending from a main wellbore, the method comprising:

pumping a fluid, using a pump positioned downhole, to a drill string disposed in the lateral well;

receiving the fluid in the lateral well to power a drilling assembly and to generate a local circulation proximate the drilling assembly in the lateral well;

transporting cuttings within the fluid away from the drilling assembly;

receiving the cuttings within the fluid in the main wellbore;

sealing the cuttings and the fluid in the main wellbore from flowing uphole past the sealing; and directing the cuttings and the fluid in a direction downhole of the sealing through a pipe positioned within and separate from a tubular positioned within the main wellbore.

16. The method of claim 15, comprising setting a deflection device in the main wellbore, wherein the pump is conveyed uphole of the deflection device and the deflection device is in fluid communication with the drill string.

17. The method of claim 15, comprising moving the pump downhole within the main wellbore and moving the drill string in the lateral well to provide a weight-on-bit to the drilling assembly.

18. The method of claim 15, comprising receiving the fluid to power the drilling assembly including a mud motor and rock destruction device.

19. The method of claim 15, wherein pumping the fluid comprises receiving a fluid from within the main wellbore.

20. The method of claim 15, comprising controlling the pump and drilling assembly from a surface using a controller.

21. The method of claim 15, wherein conveying the pump downhole comprises conveying the pump in the main wellbore and wherein the fluid is pumped from the main wellbore.

22. A downhole apparatus comprising:

a motor;

a fluid pump coupled to the motor;

a whipstock configured to provide fluid communication between a drill string in a lateral well and the fluid pump, wherein a flow of fluid from the fluid pump is configured to generate a local circulation to remove cuttings from the lateral well and power a tool in the lateral well, the lateral well extending from a main wellbore; and a sealing mechanism configured to direct the cuttings received from the lateral well in a direction downhole in the main wellbore through a pipe extending from the whipstock within and separate from a tubular positioned within the main wellbore.

23. The downhole apparatus of claim 22, wherein the motor is disposed in the main wellbore.

24. The downhole apparatus of claim 22, wherein the sealing mechanism is disposed in the main wellbore.

* * * * *